United States Patent [19]

Spence et al.

[11] 4,105,987

[45] Aug. 8, 1978

[54] POTENTIOMETERS

[75] Inventors: Gordon Spence, Swindon; Cecil Godfrey Hemmens, Purton; Alan Godfrey, Down Ampney, all of England

[73] Assignee: Plessey Handel und Investments AG, Zug, Switzerland

[21] Appl. No.: 749,370

[22] Filed: Dec. 10, 1976

[30] Foreign Application Priority Data

| | | | |
|---|---|---|---|
| Dec. 12, 1975 | [GB] | United Kingdom | 50992/75 |
| Dec. 12, 1975 | [GB] | United Kingdom | 50993/75 |
| Jan. 27, 1976 | [GB] | United Kingdom | 2992/76 |

[51] Int. Cl.[2] ..... H01C 10/16

[52] U.S. Cl. ..... 338/130; 338/164; 338/171; 338/184; 338/202; 338/198

[58] Field of Search ..... 338/128–132, 338/162–164, 184, 171–172, 200, 202, 198–199

[56] References Cited

U.S. PATENT DOCUMENTS

| | | | |
|---|---|---|---|
| 2,120,651 | 6/1938 | Schellenger | 338/132 |
| 2,650,270 | 8/1953 | Mucher | 338/129 X |
| 2,971,174 | 2/1961 | Lyon | 338/135 X |
| 3,909,769 | 9/1975 | Rozema et al. | 338/184 X |
| 3,970,986 | 7/1976 | Seyler et al. | 338/171 |
| 3,997,865 | 12/1976 | George | 338/171 |

*Primary Examiner*—C. L. Albritton

*Attorney, Agent, or Firm*—Fleit & Jacobson

[57] ABSTRACT

A potentiometer comprises a housing one end of which is closed by an insulating board which carries associated resistive and highly conductive areas or tracks arranged to be bridged by a metallic wiper loosely fitted to a wiper carrier part of an actuator such as an actuating spindle which is rotatably supported by the housing from which the spindle may project and which is preferably also rotatably supported by the insulating board.

6 Claims, 6 Drawing Figures

POTENTIOMETERS

Figure 1:
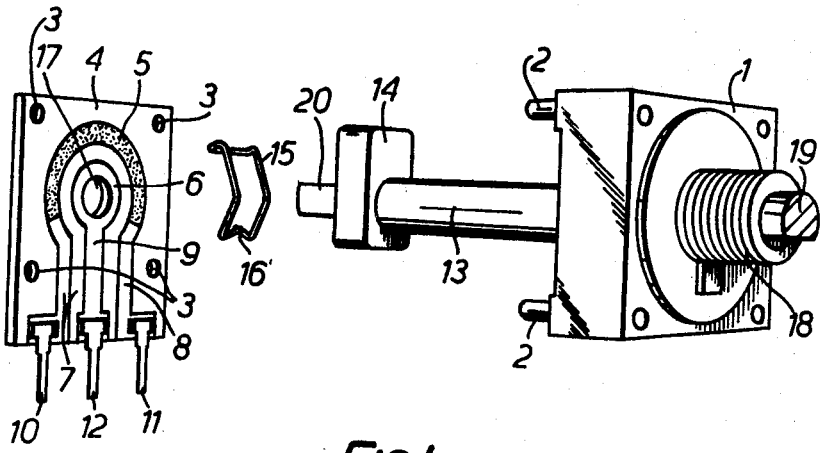
Figure 2A:
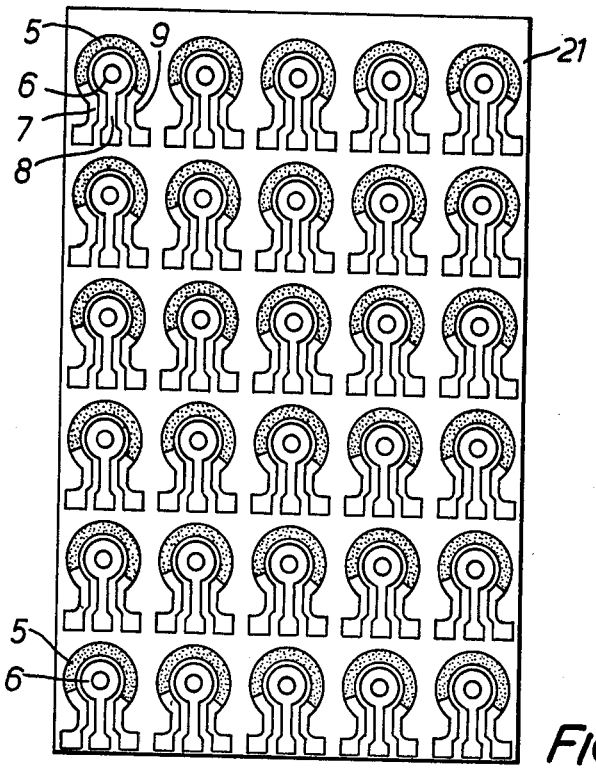
Figure 2B:
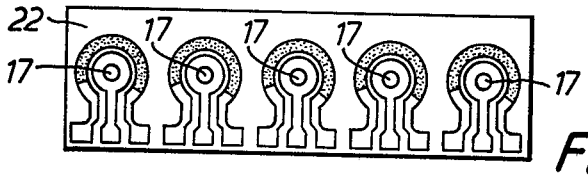
Figure 2C:
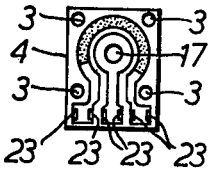
Figure 2D:
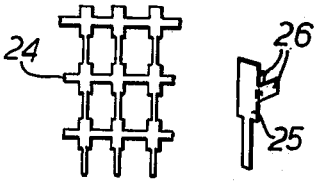
Figure 2E:
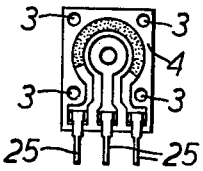

This invention relates to potentiometers, especially rotary potentiometers of the miniature type, and is directed to a simplified reliable and cheap construction of potentiometer and to improved methods of manufacturing such potentiometers which result in significantly lower manufacturing costs.

According to one feature of the present invention a potentiometer comprises a housing one end of which is closed by an insulating board which carries associated resistive and highly conductive areas or tracks arranged to be bridged by a metallic wiper loosely fitted to a wiper carrier part of an actuator such as an actuating spindle which is rotatably supported by the housing from which the spindle may project and which is preferably also rotatably supported by the insulating board.

In carrying out the invention the wiper preferably comprises a generally saddle-shaped springy metal wire member (e.g. stainless steel) the ends of which make pressure engagement with the associated resistive and highly conductive tracks on the insulating board of the potentiometer. It may advantageously be arranged that at one end of the wire wiper member overlapping ends of the wire afford twin contact portions to provide good contact engagement reliability. The metal wire member may be replaced by a metal blank formed by pressing or by etching the blank out of a thin sheet of springy metal.

It may be arranged that the wiper carrier part of the spindle substantially abuts against the tracked surface of the insulating board so that there is virtually no axial movement of the spindle, the metal wiper being held captive within a suitable cavity of the carrier part and sprung against the board track surfaces. In this way the contact pressure provided can be accurately predetermined by the depth of cavity and the form of the wiper.

For the purpose of limiting travel of the potentiometer spindle the wiper carrier part may be arranged to engage with stop means within the housing as the spindle is rotated in either direction between the limit positions.

The potentiometer housing may conveniently be provided by a metal die-casting and it may be formed with integral pins which serve as rivets for the attachment of the tracked board to the housing.

A plurality of potentiometers according to the present invention may be ganged together in which case the rear end of the spindle of the foremost potentiometer of the gang may be arranged to key into the front end of the spindle of the next potentiometer. Additionally, or alternatively, the potentiometer or potentiometers as the case may be, may be ganged together with a switch so that the spindle(s) of the potentiometer(s) is or are coupled to the switch spindle so that the switch is operated in predetermined positions of the potentiometer spindle or spindles.

According to another feature of the present invention there is provided a method of manufacturing a potentiometer as described above comprising the steps of producing on a board by a printing technique a multiplicity of track layouts each of which includes associated resistive and highly conductive tracks, separating portions of the board so that each portion embodies one of said track layouts and assembling each of said board portions in association with a potentiometer housing which accommodates a movable wiper assembly so that the wiper for said assembly bridges the associated resistive and highly conductive tracks applied to said board portions.

The board portions may have printed terminal strips which are connected with the resistive and highly conductive tracks, respectively, and to which terminals are fixedly secured to make electrical contact therewith said terminals extending from one edge of said board portion.

After the production of the separate board portions each of these board portions may be secured over the open end of a potentiometer housing into which a rotor and wiper assembly has previously been assembled. The assembling of the potentiometer is preferably carried out automatically by feeding the various potentiometer parts to an assembly machine.

The associated resistive and highly conductive tracks of a board for use in the manufacture of potentiometers as described above are produced by a silk-screen printing technique.

Silk-screen printing techniques provide significantly better dimensional control and geometry of the tracks than would be provided by spraying the material on to the board through a mask. The silk-screen technique also enables a thicker layer to be put down in one step than by a single spraying operation and, moreover, the material applied through the silk-screen is denser and thus less porous than sprayed material thereby significantly reducing ingress of air and moisture into the tracks.

By way of example the present invention will now be described with reference to the accompanying drawings in which FIG. 1 is an exploded enlarged perspective view of a miniature rotary potentiometer;

FIGS. *2a, 2b, 2c, 2d* and *2e* depict the steps in the production of the tracked board portion of the potentiometer of FIG. 1.

Referring first to FIG. 1 of the drawing, the potentiometer comprises a rectangular open-ended preferably die-cast metal housing 1. This housing 1 is formed with four integral hollow pins, two of which are indicated at 2, which are arranged to pass through holes 3 in an insulating board 4 which has applied to it by a printing process an arcuate printed resistive track 5 (e.g. screen printed conductive plastic material) and a high conductivity circular track 6 (e.g. screen printed silver). Also printed on the board 4 are high conductivity terminal strips 7, 8 and 9 connected to the tracks 5 and 6. Terminals 10, 11, 12 are staked into the terminal strips 7, 8 and 9 and to ensure good electrical contact therewith lugs (not shown) are provided on the terminals which pass through slots in the board and are pressed down on to the reverse side of the board to hold the terminals securely in position on the board.

As will be appreciated the open back end of the housing 1 will be closed by the board 4 as the ends of the hollow pins 2 passing through the board holes 3 are turned over to rivet the board to the housing. The potentiometer also includes an insulating spindle 13 having a rectangular wiper carrier part 14 which has a cavity (not shown) on the face thereof adjacent the board for receiving a generally saddle-shaped springy metal wire wiper 15 which may be of stainless steel. In this cavity is located a wiper positioning lug (not shown) integral with the spindle which may be moulded. As can be appreciated from the drawing the two ends of the wiper are arranged to engage with the outer resistive track 5 and the inner high conductivity track 6, respectively. At one end 16 of the wiper the ends of the wire overlap to provide twin contacts for good contact reliability. The rear end of the spindle is rotatably supported in a hole 17 provided in the insulating board 4 whereas the front end of the spindle passes through and is rotatably supported by a threaded boss 18 formed integrally with the die cast housing 1. The inner contours of the housing include an abutment formed integrally with the housing which limits the travel of the spindle 13 as it is rotated between limit positions in clockwise and counter clockwise directions.

The dimensioning of the potentiometer parts is such that when the board 4 is secured against the housing 1 by turning over the aforesaid pins 2 the wiper carrier structure 14 substantially abuts against the tracked board surface thereby avoiding any significant free axial play in the spindle and ensuring consistency of contact pressure between the wiper and the tracks 5 and 6 of the board.

The front end of the spindle may be provided with a flat 19 to facilitate knob fixing and the rear end 20 of the spindle may be of rectangular section to provide a key which may key into a slotted spindle end of another similar potentiometer ganged to the first potentiometer or into the slotted spindle end of a limit switch. One or more further potentiometers and/or a switch may be secured to the first potentiometer by rivets which pass through the hollow pins 2 the ends of which are turned over and corner holes in the housing of the further potentiometer(s) and or switch.

As will be apparent from the foregoing description the potentiometer according to the invention is of simple and cheap construction, lending itself well to manufacture by mass production techniques.

Also in accordance with the present invention the board 4 carrying the resistive and highly conductive tracks 5 and 6, respectively, is produced as follows, referring now to FIGS. *2a, 2b, 2c, 2d* and *2e* of the accompanying drawings.

On a relatively large insulating board 21 (e.g. phenolic base board) a multiplicity of track layouts (e.g. 30 layouts in the present example) are produced by a silk screen printing technique to lay down resistive and highly conductive areas. Each of these track layouts includes the tracks 5 and 6 depicted in FIG. 1 with their highly conductive terminal strips 7, 8 and 9 also printed on the board. When the track layouts have been printed on the board, the printed board is cured and thereafter loaded with other printed boards into a punching and cropping machine which punches out the bearing holes 17 in the track layouts and cuts the board into six strips one of which is shown at 22 in FIG. *2b*. The board may be heated by hot air in order to assist the punching operation. These strips 22 each of which has five track layouts are then fed into a magazine from which they are transferred by a pick and place head into a further punching and cropping machine which cuts the strips into five separate board portions and punches ten holes into each board portion as shown in FIG. *2c*. The holes 3 permit the passage of rivet pins as previously described and the slots 23 allow the lugs of terminals 10, 11 and 12 (FIG. 1) to pass through the board. To assist punching the board may again be heated by hot air and during punching the previously punched central hole 17 conveniently serves as locating hole for the strip in the machine. Each of the board portions has a single track layout comprising resistive track 5 and highly conductive track 6 and highly conductive terminal strips 7, 8 and 9. Terminals are then cropped from a multi-terminal stamping 24 (FIG. *2d*) consisting of rows of interconnected terminals and formed into individual terminals 25 with lugs 26. The terminal are then secured to the respective printed terminal strips 7, 8 and 9 by stagging the terminals into the strips and turning over the ends of the lugs 26 which extend through the slots 23 in the track board. These board portions are then passed to a grading machine which tests for track resistance and electrical continuity. The acceptable track board portions may then be stored in drum type containers in readiness for transfer to an assembly machine.

Completed board portions are then fed together with potentiometer housings and rotors to a rotary type multi-station assembly machine. In the assembly machine each rotor is inserted into a housing so that the spindle 13 (FIG. 1) passes through the boss 18 (FIG. 1) of the housing which is located in a suitable holder at one of the stations of the machine, after which the rotor is lifted momentarily whilst grease is applied for lubricating the bearing surfaces of the rotor and the housing. The springy wire wiper 15 is positioned in the cavity of the wiper carrier part 14 of the rotor before the track board portion is automatically positioned over the open end of the housing so that the hollow rivets 2 pass through the holes 3 in the board portion 4 after which the rivet ends are spun over to secure the board portion to the housing 1. The rotor may then be rotated to distribute the applied grease and the potentiometer tested before being discharged to a hopper.

As will be appreciated from the foregoing the potentiometer comprises only five different component parts and therefore lends itself extremely well to automatic assembly techniques as described above, but it should be understood that the assembly of the parts could be performed manually.

Referring specifically to FIG. *2a* of the drawing, the board 1 may, as previously mentioned, comprise phenolic laminated board which has applied to it by a silk screen printing technique a multiplicity (e.g. 30) track layouts.

Material for applying to the board 1 through a silk screen to form the circular tracks 6 and the connecting strips 7, 8 and 9 may comprise raw phenolic resin or mica-filled phenolic resin dissolved in benzyl alcohol and having conductive power, such as silver powder, mixed with it in order to provide the high degree of electrical conductivity. A two stage mixing process may be used which comprises a first stage in which the materials are mixed in a high speed rotary mixer followed by a milling operation to achieve the desired rheology. The resultant paste has a somewhat limited shelf-life before its conductivity value changes due to cross linking but the life of the paste may be extended considerably if the paste is refrigerated. The conductive paste is applied to the board through a silk screen so that the highly conductive tracks 6 and the conductive strips 7, 8 and 9 are produced after which the board passes through an oven at a temperature of between 150° and 200° C in order to effect curing of the conductive materials. This curing operation during which benzyl alcohol is driven off takes about ten minutes and is significantly less than for sprayed materials since much less solvent is used and therefore the amount of the solvent required to be driven off during curing is accordingly reduced.

After the highly conductive tracks and connecting strips are produced the resistive tracks 5 are laid down on the board by silk screening. For this purpose material comprising phenolic resin or mica-filled phenolic resin dissolved in benzyl alcohol together with carbon powder and possibly metallic powder may be mixed into a paste using a two-stage mixing process as previously mentioned. The amount of metallic powder, if used, will be varied according to the requisite resistance value of the resistive track material. The resistive paste is forced on to the board through the silk screen to provide the arcuate tracks 5 on the board and the board is then passed through an oven at between 150° C and 200° C for about 10 minutes in order to cure the resistive material. It is to be understood that the tracks 5 may be put down in two or more stages in order to provide a resistive track having logarithmic or other non-linear resistance characteristics.

As a modification to the method just above described the phenolic resin or the phenolic mica-filled resin may be replaced by melamine alkyds which have a very good shelf life and are stable at room temperature but preferably a polyimide is used instead of the phenolic resin. Polyimide is chemically stable and extremely resistant to solvent attack except by caustic materials. Still further, the paste for the highly conductive or resistive track materials may comprise a mixture of epoxy resin and phenolic resin which is then dissolved in benzyl alcohol with conductive and/or resistive material being added as required.

What we claim is:

1. A potentiometer comprising a housing having one open end, an insulating board closing said one end of said housing, said insulating board comprising silk-screen printed resistive and highly conductive tracks applied at a surface of said board, an actuating spindle rotatably supported by said housing and including a hollow wiper-carrying part, a saddle-shaped springy metal wire wiper loosely accommodated partially within said hollow wiper-carrying part of the actuating spindle wherein said wiper-carrying part is positioned adjacent said insulating board so that the wiper bridges between said resistive and highly conductive tracks, said wiper comprising at one end thereof overlapping ends of wire which define twin contact positions for engaging said insulating board.

2. A potentiometer, as claimed in claim 1, in which said actuating spindle is rotatably supported by said insulating board, means for securing said board to said housing comprising hollow rivets extending from said housing, said hollow rivets including means for receiving further rivets therethrough for the ganging to said potentiometer of a further potentiometer or switch, and wherein one end of said actuating spindle comprises means for coupling said actuating spindle to a further actuating spindle of said further potentiometer or switch.

3. A potentiometer, as claimed in claim 2, wherein siad housing comprises a metal die-casting and wherein said hollow rivets are formed integrally therefrom.

4. A potentiometer, as claimed in claim 1, wherein said hollow wiper-carrying part of said actuating spindle abuts against said insulating board.

5. A method of manufacturing a potentiometer including a housing, an insulating board closing one end of said housing having silk-screen printed resistive and highly conductive tracks, an actuating spindle rotatably supported by the housing and including a hollow wiper-carrying part and a saddle-shaped springy metal wire wiper loosely accommodated partially within said hollow wiper-carrying part of the actuating spindle so that the wiper bridges between said resistive and highly conductive tracks, said wiper being formed to provide at one end thereof overlapping ends of wire which define twin contact portions giving good contact engagement reliability, wherein said method comprises the steps of producing on an elongated insulating board by a silk-screen printing technique a multiplicity of track layouts each of which includes associated resistive and highly conductive tracks, separating portions of the elongated board so that each portion embodies one of said track layouts, inserting one end of the actuating spindle through a hole in one wall of the housing so that the spindle is rotatably supported by said housing, positioning a saddle-shaped springy metal wire wiper in the hollow wiper-carrying part of said spindle, said wiper being formed to provide at one end thereof overlapping ends of wire which define twin contact portions giving good contact engagement reliability, and then securing one of said board portions over the end of said housing so that the wiper bridges between the resistive and highly conductive tracks of said board portion.

6. A method, as claimed in claim 5, including the steps of punching holes in said board portion after separation thereof and securing terminals to said board portion in at least some of said holes.

* * * * *